US007681324B2

(12) United States Patent
Hooks

(10) Patent No.: US 7,681,324 B2
(45) Date of Patent: Mar. 23, 2010

(54) PREFABRICATED JIG TO POSITION AND ALIGN ROOF TRUSSES

(76) Inventor: Sherill L. Hooks, 414 Hiawatha Way, Melbourne Beach, FL (US) 32951

( * ) Notice: Subject to any disclaimer, the term of this patent is extended or adjusted under 35 U.S.C. 154(b) by 0 days.

(21) Appl. No.: 12/084,192

(22) PCT Filed: Oct. 25, 2006

(86) PCT No.: PCT/US2006/041835

§ 371 (c)(1),
(2), (4) Date: Apr. 25, 2008

(87) PCT Pub. No.: WO2007/050787

PCT Pub. Date: May 3, 2007

(65) Prior Publication Data

US 2009/0100694 A1 Apr. 23, 2009

(51) Int. Cl.
*G01D 21/00* (2006.01)

(52) U.S. Cl. ..... 33/613; 33/562

(58) Field of Classification Search ..... 33/613, 33/501, 562, 334

See application file for complete search history.

(56) References Cited

U.S. PATENT DOCUMENTS 2,567,586 A * 9/1951 Werder ..... 33/562
3,201,874 A * 8/1965 Christy ..... 33/613
4,625,415 A * 12/1986 Diamontis ..... 33/613
4,958,814 A * 9/1990 Johnson ..... 269/43
D314,520 S * 2/1991 Hass ..... D10/64
5,490,334 A * 2/1996 Payne ..... 33/613
5,628,119 A * 5/1997 Bingham et al. ..... 33/613
6,418,695 B1 * 7/2002 Daudet et al. ..... 52/677
D463,575 S * 9/2002 Daudet et al. ..... D25/61
6,993,882 B2 * 2/2006 Crawford et al. ..... 52/696
7,152,338 B2 * 12/2006 Thompson et al. ..... 33/613

* cited by examiner

*Primary Examiner*—G. Bradley Bennett
*Assistant Examiner*—Tania C Courson
(74) *Attorney, Agent, or Firm*—Larry D. Johnson

(57) ABSTRACT

A prefabricated jig or tool (10) for use in positioning and aligning roof trusses (50) during frame construction includes a lateral brace portion (12) with a pair of downwardly-depending throat members (18.20), each adapted to releasably capture a truss component (e.g. constructed from 1½ inch nominal thickness lumber). The throat members are spaced apart on the lateral brace portion a distance equal to the desired truss spacing (e.g., 24 inches on center). Nailing holes (22) are provided in the brace portion above the throat members to enable temporary nailing of the tool to the truss component(s).

3 Claims, 3 Drawing Sheets

PREFABRICATED JIG TO POSITION AND ALIGN ROOF TRUSSES

BACKGROUND OF THE INVENTION

1. Technical Field

The present invention relates generally to building construction methods and tools, and more particularly to an improved prefabricated jig for use as a tool in positioning and aligning roof trusses during frame construction.

2. Background Art

In typical frame building construction, roof trusses are spaced a set distance (e.g. 24 inches) on center using lumber that is 1½ inch nominal thickness. During construction, positioning and alignment of the trusses is accomplished by sequentially manually placing the trusses in position as measured by a tape measure, and temporarily securing the trusses in that position by nailing spare boards to the trusses to hold them in place before permanently securing them to the support walls of the building. This common construction technique is awkward and time-consuming, often results in poor alignment of the trusses, and generates substantial waste from the boards used for the temporary securing of the trusses.

U.S. Pat. No. 4,625,415 to Diamontis discloses a stud spacer for construction work comprising a rigid support to which spacers are fixed at longitudinally-spaced intervals corresponding to the distance between studs to hold the latter at the desired spacing while the studs are being secured.

U.S. Pat. No. 4,958,814 to Johnson describes a substantially integral one-piece interval locator in flat relatively thin elongate material and having two or more interval spaced notches for locating building components on selected interval positions and including hardened punch points locating and holding the centers of structural members with high precision and repetitive accuracy. The structure includes hand grip means and tapered ends.

U.S. Pat. No. 5,490,334 to Payne teaches a speed hand tool for studs, joists, rafters, and the like. This construction framing tool is provided by an elongated body member and a pair of cooperative members at its opposite ends for assembling studs, joists and rafters between headers and footers. The tool includes a holder or cradle as part of one cooperative member and a shoulder as part of the other cooperative member.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

The present invention provides an improved prefabricated jig or tool for use in positioning and aligning roof trusses during frame construction. The inventive tool includes a lateral brace portion with a pair of downwardly-depending throat members, each adapted to releasably capture a truss component (e.g., constructed from 1½ inch nominal thickness lumber). The throat members are spaced apart on the lateral brace portion a distance equal to the desired truss spacing (e.g., 24 inches on center). Nailing holes are provided in the brace portion above the throat members to enable temporary nailing of the tool to the truss component(s). Use of the inventive tool enables a finished frame structure accurately aligned to within 1/32 inch per truss.

It is therefore an object of the present invention to provide a new and improved jig for roof trusses.

It is another object of the present invention to provide a new and improved roof truss template.

A further object or feature of the present invention is a new and improved tool to position and align roof trusses.

An even further object of the present invention is to provide a novel method for the positioning and alignment of roof trusses.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the international, regional, and national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

BEST MODE FOR CARRYING OUT THE INVENTION

Figure 1:
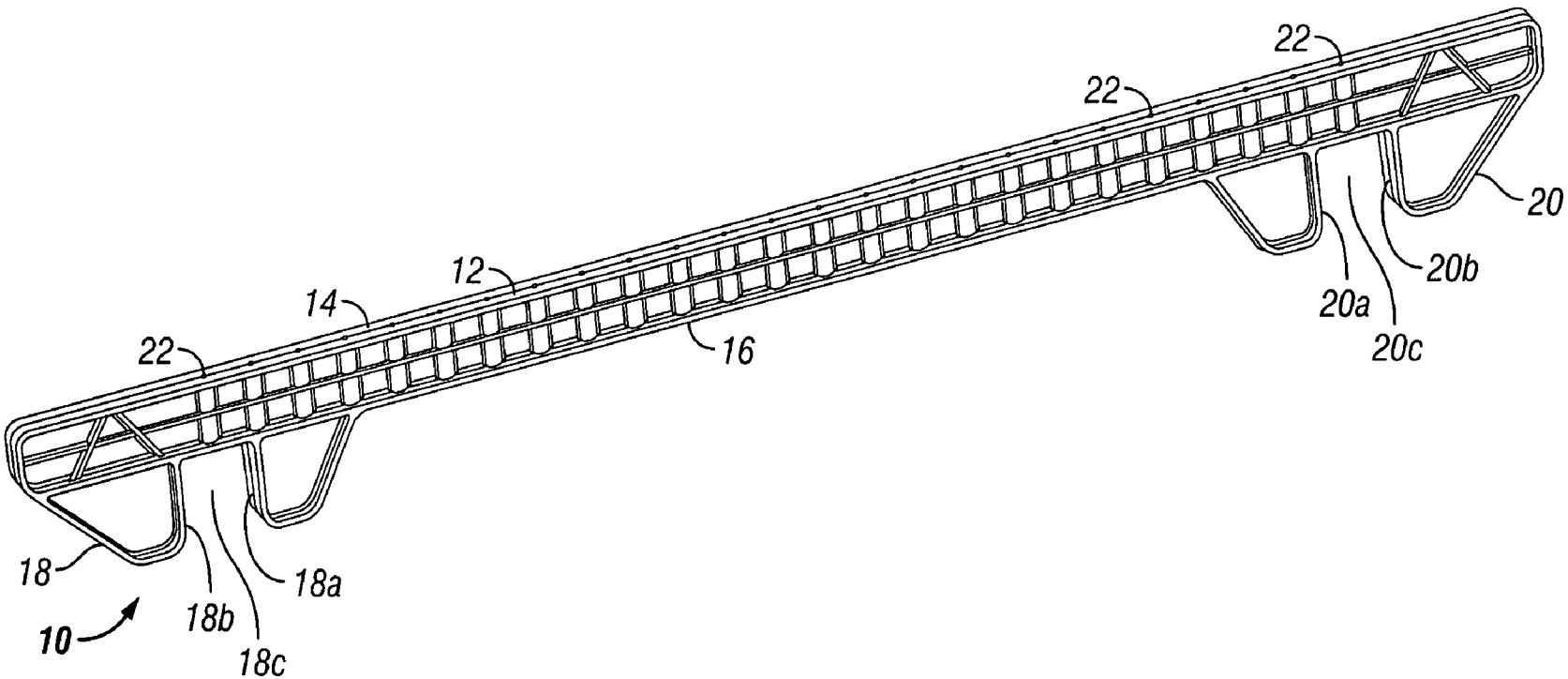
FIG. 1 is a perspective view of a prefabricated truss alignment tool of this invention.

Referring to FIGS. 1 through 5, wherein like reference numerals refer to like components in the various views, FIG. 1 is a perspective view of a prefabricated truss alignment tool 10 of this invention. Tool 10 includes a lateral brace portion 12 having an upper surface 14 and a lower surface 16, terminating at each end with a pair of downwardly-depending throat members 18, 20. Each throat member 18, 20 includes a medial wall 18*a*, 20*a*, and distal wall 18*b*, 20*b*, together defining a channel 18*c*, 20*c* adapted to releasably capture a truss component (e.g., constructed from 1½ inch nominal thickness lumber). The throat members 18, 20 are spaced apart on the lateral brace portion 12 a distance equal to the desired truss spacing (e.g., 24 inches on center). A plurality of nailing holes 22 are provided in the lateral brace portion 12, and in particular above the throat members 18, 20 to enable temporary nailing of the tool to the truss component(s).

Nailing holes 22 are preferably spaced one inch on center along the entire length of the truss alignment tool. Use of eight-penny double headed nails is preferred. Brace portion upper surface 14 is of an appropriate size to accommodate a hammer claw for use in removing the nails from the truss tool after the truss has been permanently secured, so that the truss tool 10 can be removed and reused.

The truss tool can be made in any appropriate size, e.g., approximately 32.1875 inches long by 3.312 inches high, and from any appropriate material, e.g., ABS plastic. The exposed ends of the brace portion and throat members are preferably rounded, to prevent damage to the tool and distortion of the tolerances if the tool falls to a hard surface or is otherwise impacted.

Figure 2:
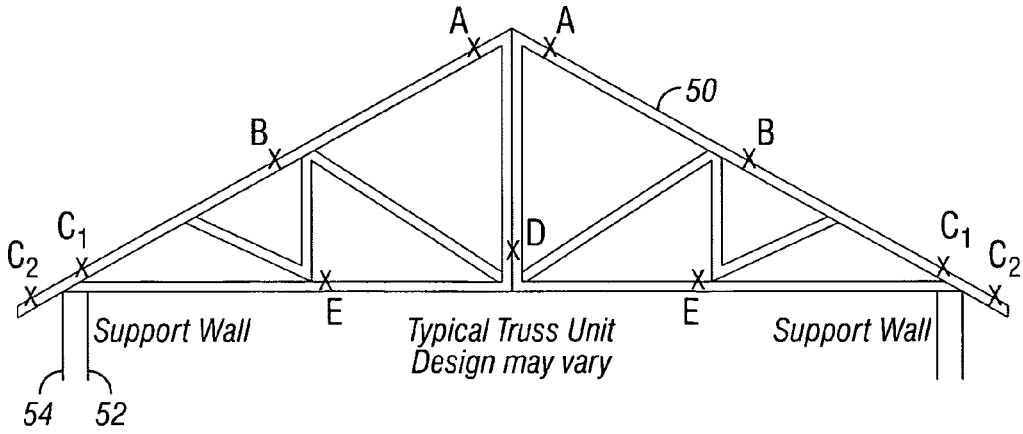
FIG. 2 is a side elevation view of a typical roof truss being installed on a building, illustrating the suggested points for installation of the truss tools of this invention.

FIG. 2 is a side elevation view of a typical roof truss 50 being installed on the support walls 52 of a building 54, illustrating the suggested points for installation of the truss tools of this invention. For example:

Position A: Install one unit approximately 2 ft. from the ridge point on each side of the ridge.

Position B: Install one unit approximately half the distance from the ridge to the wall connection, not to exceed 12 ft. between the units.

Position C1: Use the units to gauge distance between trusses at position C1, then remove and reinstall at position C2 approximately 6 inches from the end of the truss tail.

Position D: Install one unit at the center of the bottom cord of the truss.

Position E: Install one unit approximately half the distance from the center to the wall connection, not to exceed 12 ft. between the units.

Figure 3:
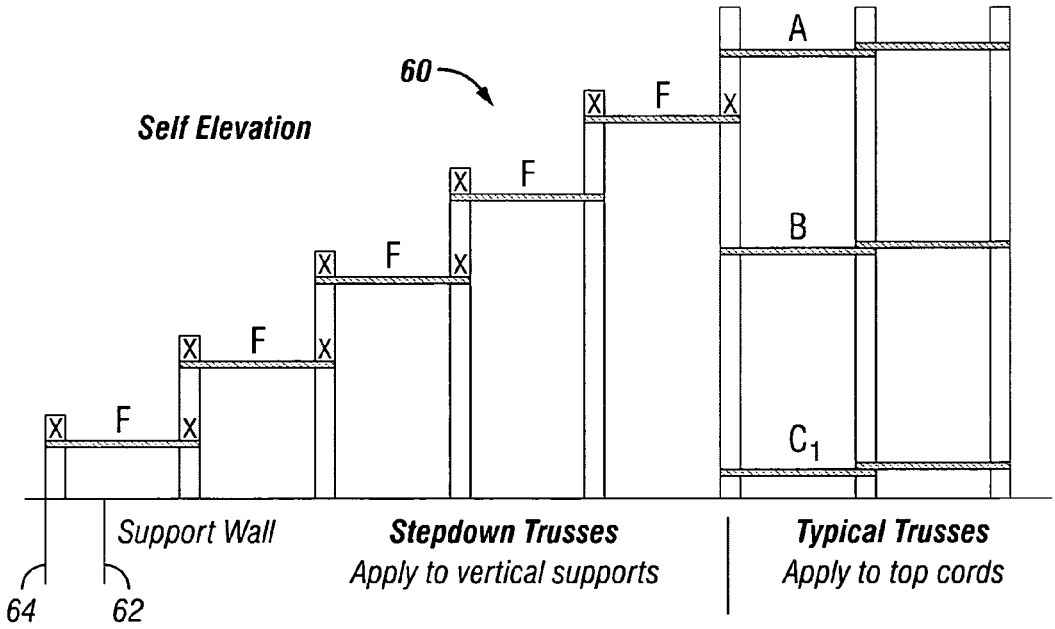
FIG. 3 is a side elevation view of a step-down roof truss being installed on a building, illustrating the suggested points for installation of the truss tools of this invention.

FIG. 3 is a side elevation view of a step-down roof truss 60 being installed on the support wall 62 of a building 64, illustrating the suggested points for installation of the truss tools of this invention. For example:

In the case of step-down hip trusses, install the inventive tool on its side at position F and fasten to the vertical truss supports at the X marks.

Although the inventive truss alignment tool is primarily meant to be used on standard wood roof truss systems, of which approximately 95% are the same, the truss tool has been designed to be able to be field modified to accommodate various situations such as started trusses, non-gauged trusses, double trusses, and hip style trusses.

Figure 4:
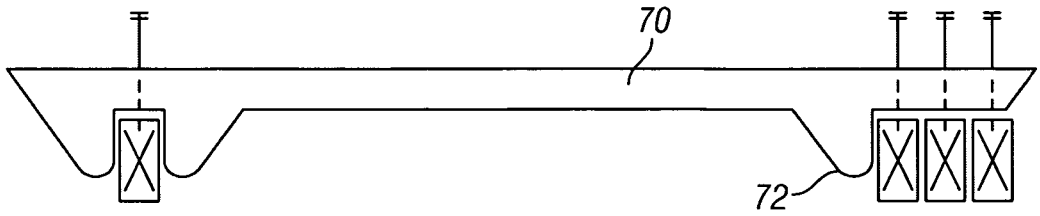
FIG. 4 is a side elevation view of a field modified truss tool of this invention, illustrating the distal wall of one throat member having been removed enabling use with multiple truss sets.

FIG. 4 is a side elevation view of a field modified truss tool 70 of this invention, illustrating the distal wall of one throat member 72 having been removed enabling use with sheeted or multiple truss sets or bottom cord multiple truss sets. This procedure provides an extra four inches of nailing platform to bridge over sheeted or double/triple truss sets.

Figure 5:
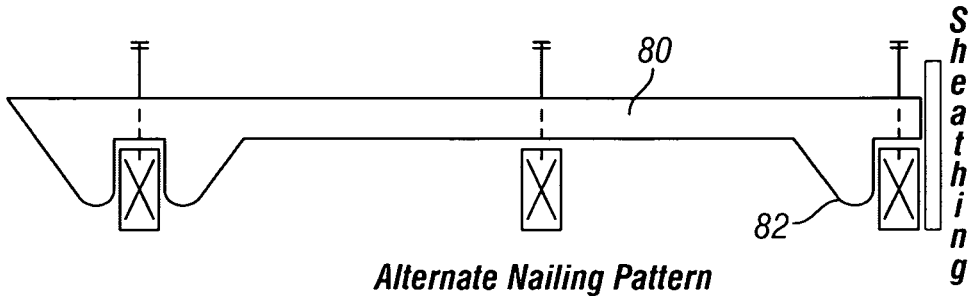
FIG. 5 is a side elevation view of an alternate field modified truss tool of this invention, illustrating the distal wall of one throat member and a portion of the brace portion having been removed enabling use as a starter tool that butts against sheathing.

FIG. 5 is a side elevation view of an alternate field modified truss tool 80 of this invention, illustrating the distal wall of one throat member 82 and a portion of the brace portion 84 having been removed enabling use as a starter tool that butts against sheathing. This procedure is for a starter tool that butts against sheathing and holds alignment at 24 in. on center. For spacing of less than 24 in. on center the tool may be set at any point along its length and fastened through the pre-existing nail holes. After applying the starter tools, proceed with the standard truss spacing pattern.

The inventive truss alignment tool can also be changed in design by adapting the throat of the tool to accept floor trusses, e.g. 3½" openings as opposed to 1½" openings. It can also be modified to accept 16 inch on center trusses for standard framing of walls, ceiling joists, rafters, etc. Another adaptation is to change the overall length and throat design to fit steel web beam truss systems.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. A tool for aligning roof trusses, said tool comprising:

a lateral brace portion having an upper surface and a lower surface and a pair of ends;

a downwardly-depending throat member on each of said lateral brace portion ends, each throat member including a medial wall and distal wall together defining a channel adapted to releasably capture a truss component, wherein said throat members are spaced apart on said lateral brace portion a distance equal to the desired truss spacing; and at least one nailing holes in said lateral brace portion located above each of said throat members to enable temporary nailing of said tool to the respective truss components.

2. The tool for aligning roof trusses of claim 1 further including a plurality of nailing holes spaced on inch on center along the length of said tool.

3. The tool for aligning roof trusses of claim 1 wherein said lateral brace portion upper surface is of an appropriate size to accommodate a hammer claw for use in removing nails from said tool after the truss has been permanently secured.

* * * * *